US011518003B1

(12) United States Patent
Loucks

(10) Patent No.: US 11,518,003 B1
(45) Date of Patent: Dec. 6, 2022

(54) APPARATUS FOR REMOVING A POOL DECK LID AND BASKET AND FOR COLLECTING A WATER SAMPLE

(71) Applicant: Drew J. Loucks, Clovis, CA (US)

(72) Inventor: Drew J. Loucks, Clovis, CA (US)

( * ) Notice: Subject to any disclaimer, the term of this patent is extended or adjusted under 35 U.S.C. 154(b) by 422 days.

(21) Appl. No.: 16/729,090

(22) Filed: Dec. 27, 2019

(51) Int. Cl.
*B25B 7/04* (2006.01)
*E04H 4/12* (2006.01)

(52) U.S. Cl.
CPC ..... *B25B 7/04* (2013.01); *E04H 4/1272* (2013.01)

(58) Field of Classification Search
CPC ..... B25B 7/04; E04H 4/1272
USPC ..... 210/167.1; 294/66.1, 106, 210
See application file for complete search history.

(56) References Cited

U.S. PATENT DOCUMENTS 3,856,679 A * 12/1974 Jackson ..... E04H 4/1272 210/471
6,422,623 B1 * 7/2002 Thomas ..... B66F 19/005 294/24
9,016,738 B2 * 4/2015 Smith ..... E04H 4/16 294/99.2
9,387,583 B1 * 7/2016 Coan ..... E04H 4/14
10,835,846 B1 * 11/2020 Carpenter ..... B25J 1/04
2007/0108784 A1 * 5/2007 Fiore ..... E04H 4/1272 294/66.1
2009/0243318 A1 * 10/2009 Pratt ..... B65G 7/12 294/209
2010/0303602 A1 * 12/2010 Murphy ..... B66F 19/005 294/26
2014/0015267 A1 * 1/2014 Smith ..... E04H 4/14 294/28
2014/0327257 A1 * 11/2014 Vazquez ..... E04H 4/16 294/24

* cited by examiner

*Primary Examiner* — Fred Prince
(74) *Attorney, Agent, or Firm* — Richard A. Ryan

(57) ABSTRACT

An apparatus that is utilized with a pool skimming system to remove a deck lid from a skimmer reservoir and a skimmer basket from inside the skimmer reservoir while the user remains in a standing position. The apparatus has an elongated handle and an engaging mechanism. The engaging mechanism, which is at a lower end of the handle, has an inverted U-shaped engaging member with a pair of spaced apart outwardly extending engaging projections that engage slots in the deck lid to remove the deck lid from the skimmer reservoir and then engage a basket handle of the basket to remove the basket from the skimmer reservoir. The apparatus can include an adjusting mechanism to adjust the distance between the engaging projections of the engaging mechanism and/or a sampling mechanism having an integral correct depth indicating mechanism to obtain a water sample from a body of water.

20 Claims, 7 Drawing Sheets

APPARATUS FOR REMOVING A POOL DECK LID AND BASKET AND FOR COLLECTING A WATER SAMPLE

BACKGROUND OF THE INVENTION

A. Field of the Invention

The present invention relates generally to apparatuses that are useful for maintaining the cleanliness and water quality of swimming pools and the like. In particular, the present invention relates to such apparatuses that are configured to allow the user to easily and quickly accomplish regular maintenance activities for swimming pools having a skimming system which is configured to collect debris from the pool's swimming area into a skimmer basket. Even more particularly, the present invention relates to such apparatuses that are specially configured to allow the user to easily and quickly access and empty the skimmer basket and to collect a water sample from an appropriate depth in the pool for use in testing the quality of the water.

B. Background

Many people have swimming pools that are located in the backyard or other outdoor area of their home. Such outdoor, home-based swimming pools are commonly utilized for exercise, playing and other water activities, including merely floating in or otherwise relaxing in or by the pool. As well known to persons who have or utilize such swimming pools, in order to be able to safely swim in and enjoy doing the various other pool-related activities in or by the pool, certain maintenance activities are required to keep the water in the pool chemically balanced and the water and surfaces of the pool clean. Among such maintenance activities are testing the water in the swimming pool on a regular basis and applying appropriate chemicals to the water to ensure that the pH, alkalinity, hardness, total dissolved solids, saturation index and the like are within acceptable levels to keep the water clear and free of potentially harmful bacterial, biological and other matter that could negatively affect persons who swim in the pool, damage the pool equipment and stain the surfaces of the pool. Another important, regularly performed maintenance activity is to remove leaves, branches, flowers and other plant material, as well as other debris, from the water of the pool. In addition to the debris being unsightly and unpleasant to be around, the presence of such debris in the water has a negative impact on the water quality and the user's ability to control or improve the quality of the water with the application of chemicals.

With regard to removing plant and other debris from the water of a swimming pool, there are several commonly utilized approaches to removing such debris. One approach is to utilize a hand-held net, typically removably attached to a long handle, to scoop out debris that is floating on or near the surface of the pool water. Brushes are used to scrape the side and bottom walls of the swimming pool to direct small, loose debris at least generally toward a drain that is located at the low spot in the pool, with the drain being hydraulically connected to a pump and filtering equipment that forces the water through filters to remove the smaller-sized debris from the pool water. In addition to the hand-operated methods of removing debris from a swimming pool described above, most swimming pools also have a skimming system that is specially configured to direct debris out of the swimming pool into a separate, but hydraulically connected, skimmer reservoir. For most home swimming pools, the skimmer reservoir is a hole-like opening that is located in the deck next to the swimming pool which is readily accessible to the user. The typical swimming pool skimming system has a skimmer deck lid that is sized and configured to fit on top of or over the skimmer reservoir to cover the reservoir opening so persons can walk across the deck without falling into the opening.

To collect debris in the skimmer reservoir and assist the user with removing the collected debris from the reservoir, most skimming systems have a skimmer basket that is removably positioned in the reservoir. To allow water to circulate through the skimmer reservoir, and thereby deposit the debris in the basket, and prevent the debris that was "skimmed" by the skimming system into the basket from reentering the pool through the skimmer reservoir, the basket has a plurality of apertures, arranged in a screen-like configuration, on its sides and bottom through which the water passes and against which the debris is held inside the basket. To remove the debris from the pool, the user removes the deck lid and accesses the interior of the basket to remove the collected debris from the basket. In one use, the person cleaning the skimmer reservoir kneels on the deck and reaches into the basket, which is often located ten inches or more below the deck, to scrape the debris out of the basket while the basket remains in the skimmer reservoir. Typically, however, the person will reach down and remove the basket from the reservoir and then dump, scrape and/or wash the debris out of the skimmer basket onto the ground or into a trash or other container. To assist with removing the debris from the basket, the basket typically has a handle, which is located well below the pool deck, that the user utilizes to pull the basket out of the skimmer reservoir. For most skimmer baskets, the handle is a rigid, elongated member that is positioned across the interior area of the basket below the upwardly facing opening of the basket. Once the basket is emptied, rinsed out and/or otherwise cleaned, the user kneels down to place the basket back into the skimmer reservoir and repositions the deck lid over the reservoir.

As well known to persons who are skilled in the relevant art, to remove the deck lid from the deck and the skimmer basket from the reservoir, the user typically accesses and removes the deck lid and the basket by bending over the skimmer reservoir, squatting down next to the reservoir or kneeling onto the deck next to the reservoir. For many persons who work with pool skimming systems, the action of bending over, squatting down or kneeling onto the deck can be difficult or even very painful due to problems with the person's knees, back and/or shoulders. These problems are exasperated by the fact that the person will have to repeat the motions at least twice to remove the debris-filled skimmer basket and to replace the clean basket back into the reservoir. In addition to difficulty with removing and replacing the basket, the person has to reach inside the basket below the level of water in the reservoir to grab onto the basket's handle, which is commonly located below the top of the basket. In the winter months, the water in the reservoir can be quite cold and, as a result, can make reaching into the water to remove the basket somewhat uncomfortable. Due to the problems with removing and cleaning out the skimmer basket, this work is often neglected and not performed on the regular or routine basis which is necessary for a clean pool.

With regard to testing the water in the pool, spa or the like swimming area to determine which and what amount of chemicals, if any, need to be added to the water to ensure the water is clean and safe, it is necessary to obtain a water test sample from the body of water. Because the test sample will be subject to the various chemical tests and analysis to determine whether to add chemicals or initiate other treatment procedures, it is important that the test sample be as an accurate representation of the chemical condition of the body of water as possible. To obtain an accurate representative fluid test sample, those in the swimming pool industry and others involved in testing water know it is strongly preferred to obtain the test sample from a location that is well below the surface of the water and away from the pool's inlet and water return lines. As well known, sunlight, UV light, evaporation and various surface environmental conditions negatively affect the accuracy of water samples that are taken from near the surface of the water. Specifically, chemical tests that are performed on water test samples taken from at or near the surface of the water body or near a water inlet or outlet, such as the pool pump or filtration system, is likely to provide inaccurate and unreliable chemical data. Corrective action, such as the withholding or adding of chemicals to the water in the pool that is based on a bad water sample, is very likely to be ineffective and even potentially harmful to the swimmers as well as the swimming pool structure and equipment.

The ideal sample should be from a depth that is sufficiently below the surface of the water to avoid the inaccuracy problems associated with samples that are taken at or near the surface. Specialists in the swimming pool industry typically recommend the user or tester obtaining the water test sample from a depth of at least twelve to eighteen inches below the surface of the water. To simplify the procedure for the average user, many pool test kit suppliers recommend obtaining the sample from "elbow" depth, meaning the depth below the surface when the person's elbow is at the surface of the pool. Typically, in order to obtain a water sample from the preferred depth below the surface of the water, the person obtaining the water test sample must manually lower the water collection device in his or her hand to the desired depth (often by laying down on the deck), allow water to flow into the device and then close off the device so the water from the depth will remain in the device. A commonly utilized device is a water bottle or tube that is configured so the user can close off the inlet of the bottle with his or her thumb or finger. When used to obtain a water sample from a swimming pool, the user generally either kneels or lays down on the deck of the pool so that he or she can reach into the water a sufficient amount to collect water from the desired depth. As known to those who have swimming pools or those who otherwise maintain swimming pools, kneeling or laying on the pool deck can be quite uncomfortable in hot or cold locations that result in the deck being hot or cold. For persons who have weak, injured or otherwise limited mobility in their knees, hips and/or back, this process can be somewhat painful, specially for older persons. Even for healthy persons, particularly those who are in the water cleaning and testing business who frequently obtain water samples, the repeated task of kneeling or laying down to get a water test sample can be quite trying, as well as time consuming. In addition, the surface around the pool can be hot, rough or otherwise somewhat uncomfortable to lie or kneel down on and, depending on the time of the year, the water can be quite cold. The difficulty with kneeling or otherwise getting near enough to the surface of the water so as to lower the collection device to the preferred depth in the water often results in the user reducing his or her effort and/or pain by collecting a water sample that is much nearer the surface than is recommended or desired. As a result, the tests performed on the test sample are often inaccurate and result in an ineffective or damaging treatment response.

What is needed, therefore, is an improved apparatus for use with maintaining the cleanliness and water quality of the water in swimming pools, spas and the like that have a skimming system to collect and remove surface debris from the water, with the system having a basket which is removably positioned inside a skimmer reservoir that is covered by a deck lid. More specifically, what is needed is a new apparatus that is structured and arranged to assist a person with removing the skimmer deck lid from its position over the skimmer reservoir and the basket from inside the reservoir and then replacing these components back into their respective positions. The new apparatus should be configured to allow a person to easily and efficiently remove the skimmer deck lid from the deck and the basket from the reservoir without having to bend over, squat down next to or kneel on the deck to remove and replace the skimmer deck lid and basket. The new apparatus should be sized and configured to allow the user to engage, remove and replace the skimmer deck lid and basket while he or she is in a standing position on the deck next to the skimmer reservoir. Preferably, the new apparatus should be adaptable for use with a variety of different types and sizes of swimming pool skimming systems. In a preferred configuration, the new apparatus should also be configured to assist the user with obtaining a water sample from sufficiently below the surface of the water and accommodate different sizes of deck lids and skimmer basket without having to kneel or lay down on the pool deck and have to insert his or her arm into the water. Preferably, the new apparatus should be easy to use and relatively inexpensive to manufacture so that it can be widely utilized.

SUMMARY OF THE INVENTION

The new apparatus of the present invention provides the benefits and solves the problems that are identified above. That is to say, the apparatus of the present invention is useful for helping a person to maintain the cleanliness and water quality of the water in a swimming pool, spa and like swimming area having a skimming system which is configured to collect and remove leaves, twigs and other surface debris from the water. More specifically, the present invention is a new apparatus that is specially structured and arranged to assist a user with removing the skimmer deck lid from its position over the skimmer reservoir and the skimmer basket from inside the skimmer reservoir and then replacing these components back into their respective positions after emptying debris from the basket. The new apparatus allows a person to easily and efficiently remove the skimmer deck lid from the deck and the basket from the reservoir without the user having to bend over, squat down next to or kneel on the deck to remove and replace the skimmer deck lid and basket. Specifically, the new apparatus is sized and configured to allow the user to engage, remove and replace the skimmer deck lid and basket while he or she is in a standing position, typically on the deck next to the skimmer reservoir. As such, the new apparatus will be particularly beneficial for persons who have sore knees, backs, shoulders or other body parts that make it difficult for the user to safely and painlessly remove the deck lid and basket. In addition, the new apparatus eliminates the need for a person to have to reach into the skimmer reservoir, which can be filled with very cold water, to remove the basket. The new apparatus can be made out of lightweight, easy to handle materials and it is readily adaptable for use with a wide variety of different types and sizes of skimmer deck lids and baskets. In some embodiments, the new apparatus also has a sampling mechanism for easily and painlessly obtaining a water sample from an appropriate depth in a pool, spa, hot tub or other body of water. In the preferred configurations of the present invention, the new apparatus is very easy to use and relatively inexpensive to manufacture, which will allow the new apparatus to be widely utilized and available.

In one embodiment of the present invention, the new apparatus for removing and replacing the deck lid and skimmer basket of a pool's skimming system generally comprises a handle and an engaging mechanism. The handle has an elongated handle body that defines a first end and a second end of the handle, with the handle having an elongated handle axis disposed through the handle body from the first end to the second end thereof. In one of the preferred embodiments, the handle is tubular and made from PVC or other plastic. The engaging mechanism, which is at the second end of the handle, is structured and arranged to engage each of a first slot and a second slot in the deck lid to remove the deck lid from the skimmer reservoir and to engage a basket handle of the skimmer basket to remove the skimmer basket from inside the skimmer reservoir. The engaging mechanism comprises an engaging member that is disposed in an inverted U-shaped configuration to define a first side, a second side, an upper end, a lower end, a front side and a back side of the engaging mechanism. To engage the slots and the basket handle, the engaging mechanism further comprises a first engaging projection extending outwardly in a forwardly direction from the first side of the engaging mechanism and a second engaging projection extending outwardly in an opposite facing rearwardly direction from the second side of the engaging mechanism. In a preferred embodiment, the engaging projections are at the lower end of the engaging mechanism and extend perpendicular from the spaced apart sides of the engaging mechanism. The first engaging projection is sized and configured to be removably received in the first slot of the deck lid and the second engaging projection is sized and configured to be removably received in the second slot of the deck lid when the first engaging projection is in the first slot so as to separate the deck lid from the skimmer reservoir by rotating the handle of the apparatus. Each of the engaging projections are further sized and configured to engage the basket handle of the skimmer basket. In use, the handle and the engaging mechanism of the apparatus are cooperatively structured and arranged to allow a user to separate the deck lid from the skimmer reservoir and to remove the skimmer basket from inside the skimmer reservoir while the user is in a standing position.

In a preferred configuration, each of the first engaging projection and the second engaging projection are sized and configured to be received under the basket handle of the skimmer basket after the basket handle is received in a gap between the first side and the second side of the engaging mechanism and the engaging mechanism is rotated toward the basket handle. In addition, each of the first engaging projection and the second engaging projection are sized and configured to extend, respectively, beyond a slot edge of the first slot and the second slot of the deck lid so as to fully engage the deck lid.

In an alternative embodiment, the apparatus also has an adjusting mechanism associated with at least one of the engaging mechanism and the handle for adjusting an engaging width between the first side and the second side of the engaging mechanism to allow the user to adjust the position of the first engaging projection and second engaging projection to correspond to the position of the first slot and the second slot of the deck lid and to the basket handle of the skimmer basket. In one configuration, the adjusting means has a flexible V-shaped center section that is associated with the engaging member between the first side and second side of the engaging mechanism and the handle has an elongated inner handle member that is slidably associated with a moveable section of the handle to move the engaging mechanism between a wide first engaging width and a narrow second engaging width. The center section is located at a lower end of the inner handle member to be flexibly engaged by the moveable section of the handle so as to move the engaging mechanism between the first engaging width and the second engaging width. The center section can be received in an interior chamber of the inner handle member and secured to the inner handle member by one or more connecting devices, such as screws, bolts and the like. An upper end of the inner handle member can be attached to a fixed section of the handle.

In other embodiments, the new apparatus can also have a sampling mechanism, which can be in addition to the adjusting mechanism, for obtaining a water sample from a body of water. In one embodiment, the sampling mechanism comprises a water bottle at the first end of the handle and an inlet aperture at or near the water bottle so as to receive the water sample therein. To facilitate water entering the water bottle below the surface of the body of the water, the sampling mechanism further comprises one or more venting apertures associated with the handle. In a preferred configuration, the venting apertures are on the elongated inner handle member that is slidably associated with a moveable section of the handle of the adjusting mechanism. The inner handle member and the moveable section are cooperatively structured and arranged to allow the moveable section to move relative to the inner handle member to expose the venting apertures to cause the water sample from the body of water to flow into the water bottle while the air in the empty bottle forces jets of water out of the venting apertures, creating easily heard water jet sounds that stop when the sampling bottle is full. The correct and repeatable pool water sampling depth is indicated under the venting apertures.

Accordingly, the primary object of the present invention is to provide a new apparatus for removing and replacing the deck lid and skimmer basket from the reservoir of a skimming system that has the advantages set forth above and which overcomes the disadvantages and limitations which are associated with presently available apparatuses and procedures for removing and replacing the deck lid and skimmer basket and for gathering pool water samples.

It is an important object of the present invention to provide a new apparatus that is specially structured and arranged to allow the user thereof to easily, quickly and effectively engage, remove and then replace the deck lid and skimmer basket of a pool skimming system while he or she is in a standing position so as to eliminate the user having to bend over, squat down next to or kneel on the deck adjacent the skimmer reservoir to remove and replace the deck lid and skimmer basket without the user having to place his or her hand in the often fouled debris collected in the skimmer basket.

It is also an important object of the present invention to provide a new apparatus that is specially structured and arranged to allow the user thereof to easily, quickly and effectively obtain a sample of water from below the surface of the water without having to kneel or lay down on the pool deck and without the user having to insert his or her arm into the water.

An important aspect of the present invention is that it provides a new apparatus for removing and replacing the deck lid and skimmer basket from the reservoir of a skimming system and for obtaining a water test sample from an appropriate depth in a body of water which accomplishes the objectives set forth above and elsewhere in the present disclosure.

Another important aspect of the present invention is that it provides a new apparatus to easily, quickly and efficiently remove and replace different sizes of deck lids, including a pool water skimmer lid, and a skimmer basket from the reservoir of a skimming system and to obtain a water sample from the preferred depth of a pool, spa, hot tub or other body of water in order to assist the user of the apparatus with maintaining the cleanliness and water quality of the water in a swimming pool, spa and like swimming area.

Another important aspect of the present invention is that it provides a new apparatus which is structured and arranged to allow a user thereof to engage, remove and replace the deck lid and skimmer basket of a skimming system from a standing position so as to eliminate the user having to bend over, squat down next to or kneel on the deck adjacent the skimmer reservoir to remove and replace the deck lid and skimmer basket.

Another important aspect of the present invention is that it provides a new apparatus which eliminates the need for a person to have to reach into the skimmer reservoir of a pool skimming system to remove the skimmer basket from the reservoir so he or she will not have to reach his or her hand into the reservoir, which can be filled with very cold water or dead mice, birds, slugs and/or pool slime from leaves or bird droppings, to remove the basket.

Another important aspect of the present invention is that it provides a new apparatus for easily, quickly and efficiently removing and replacing the deck lid and skimmer basket from the reservoir of a skimming system which is adaptable for use with different types of skimming systems that may have a variety of different sizes and shapes of skimmer deck lids and baskets.

Another important aspect of the present invention is that it provides a new apparatus for assisting the user with easily, quickly and efficiently for obtaining a sample of water from sufficiently below the surface of the water without having to kneel or lay down on the pool deck and without the user having to insert his or her arm into the water.

Yet another important aspect of the present invention is that it provides a new apparatus for removing and replacing the deck lid and skimmer basket from the reservoir of a skimming system and for obtaining a water sample from a body of water which, in the preferred configurations, is easy to use and relatively inexpensive to manufacture.

As will be explained in greater detail by reference to the attached figures and the description of the preferred embodiments which follow, the above and other objects and aspects are accomplished or provided by the present invention. As set forth herein and will be readily appreciated by persons who are skilled in the art, the present invention resides in the novel features of form, construction, mode of operation and combination of processes presently described and understood by the claims. The description of the invention which follows is presented for purposes of illustrating one or more of the preferred embodiments of the present invention and is not intended to be exhaustive or limiting of the invention. The scope of the invention is only limited by the claims which follow after the discussion.

BRIEF DESCRIPTION OF THE DRAWINGS

In the drawings which illustrate the preferred embodiments and the best modes presently contemplated for carrying out the present invention.

DETAILED DESCRIPTION OF THE PREFERRED EMBODIMENTS

With reference to the figures where like elements have been given like numerical designations to facilitate the reader's understanding of the present invention, the preferred embodiments of the present invention are set forth below. The enclosed figures are illustrative of several potential preferred embodiments and, therefore, are included to represent several different ways of configuring the present invention. Although specific components, materials, configurations and uses are illustrated, it should be understood that a number of variations to the components and to the configuration of those components described herein and shown in the accompanying figures can be made without changing the scope and function of the invention set forth herein. For instance, although the description and figures included herewith generally describe and show particular materials, shapes and configurations for the various components of the apparatus of the present invention, as well as an example of a pool skimming system, including a skimmer deck lid, skimmer basket and skimmer reservoir thereof, with which the new apparatus may be utilized, persons who are skilled in the art will readily appreciate that the present invention is not so limited. In addition, the exemplary embodiments of the present invention are shown and described herein with only those components that are required to disclose the present invention. As such, it may be possible that some of the necessary elements for attaching and using the present invention are not shown or necessarily described below, but which are well known to persons who are skilled in the relevant art. As will be readily appreciated by such persons, the various elements of the present invention that are described below may take on any form which is consistent with forms that may be understood by a person of ordinary skill in the art having knowledge of pool skimming systems and means of removing the skimmer deck lid and skimmer basket therefrom.

Figure 1:
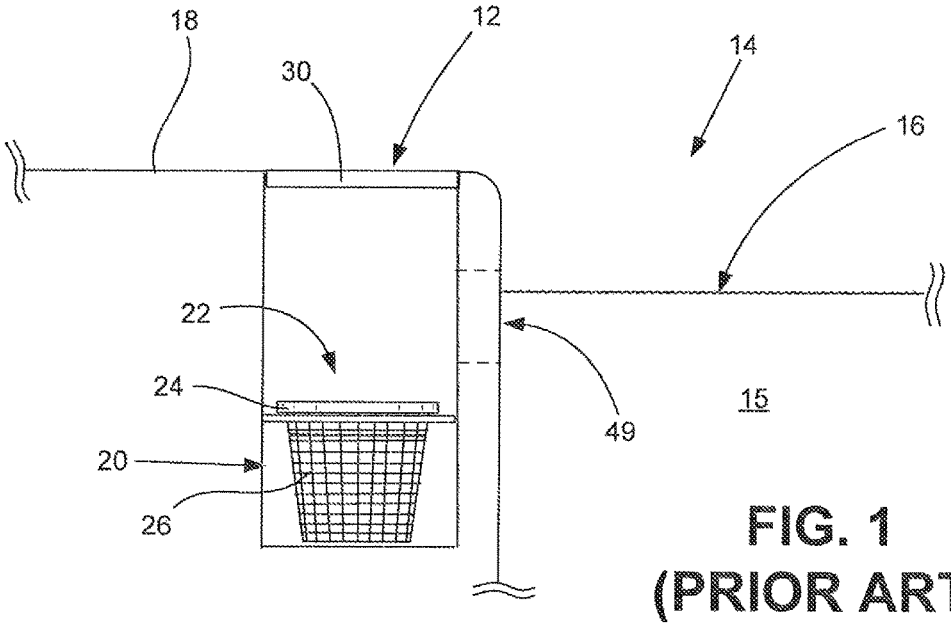
FIG. 1 (PRIOR ART)
FIG. 1 is a side view of a prior art swimming pool having a skimming system showing the components thereof with the skimmer basket in the skimmer reservoir.
Figure 3:
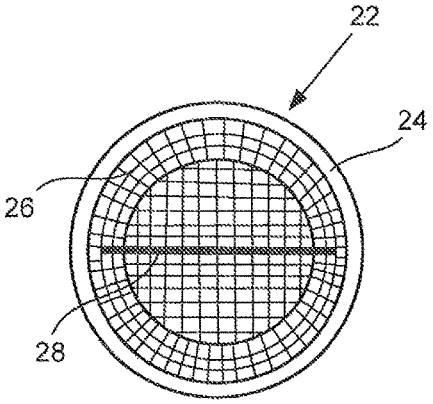
FIG. 3 PRIOR ART
FIG. 3 is a top view of the prior art skimmer basket of FIG. 1.
Figure 4:
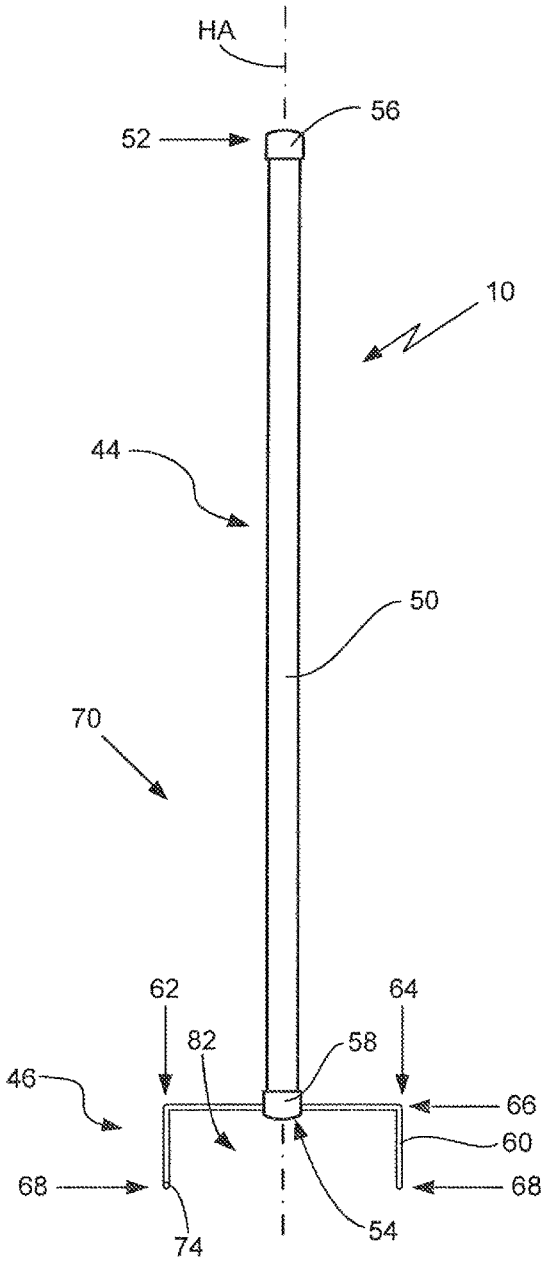
FIG. 4 is a front view of an apparatus for removing the prior art skimmer deck lid and skimmer basket of FIGS. 1-3 from the skimmer reservoir of FIG. 1 that is configured according to a first embodiment of the present invention.
Figure 5:
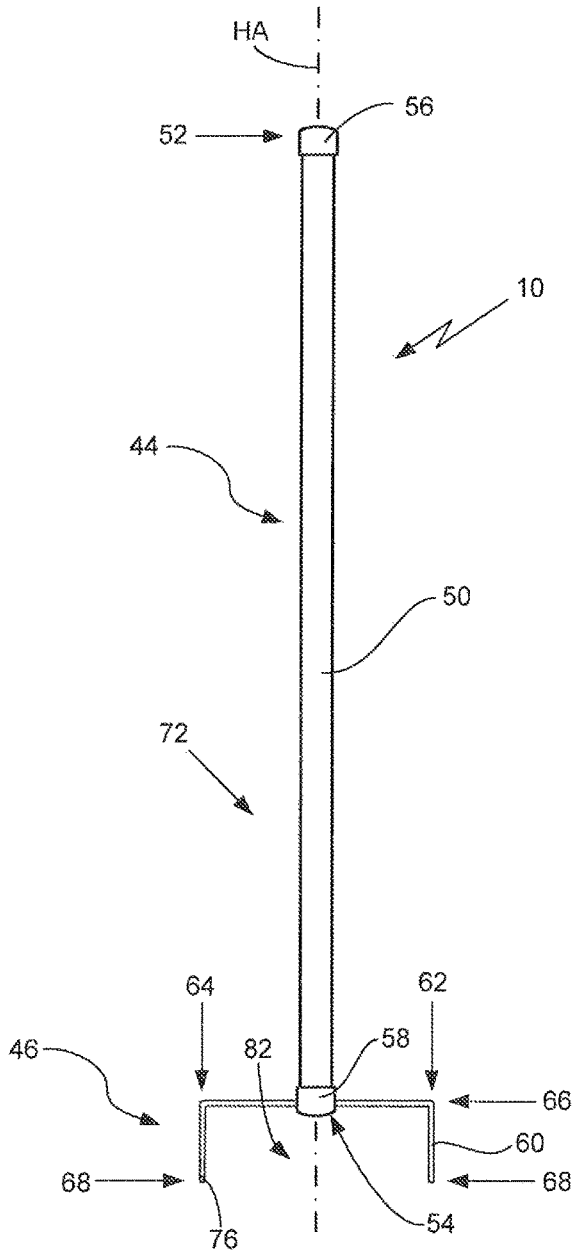
FIG. 5 is a back view of the apparatus of FIG. 4.
Figure 14:
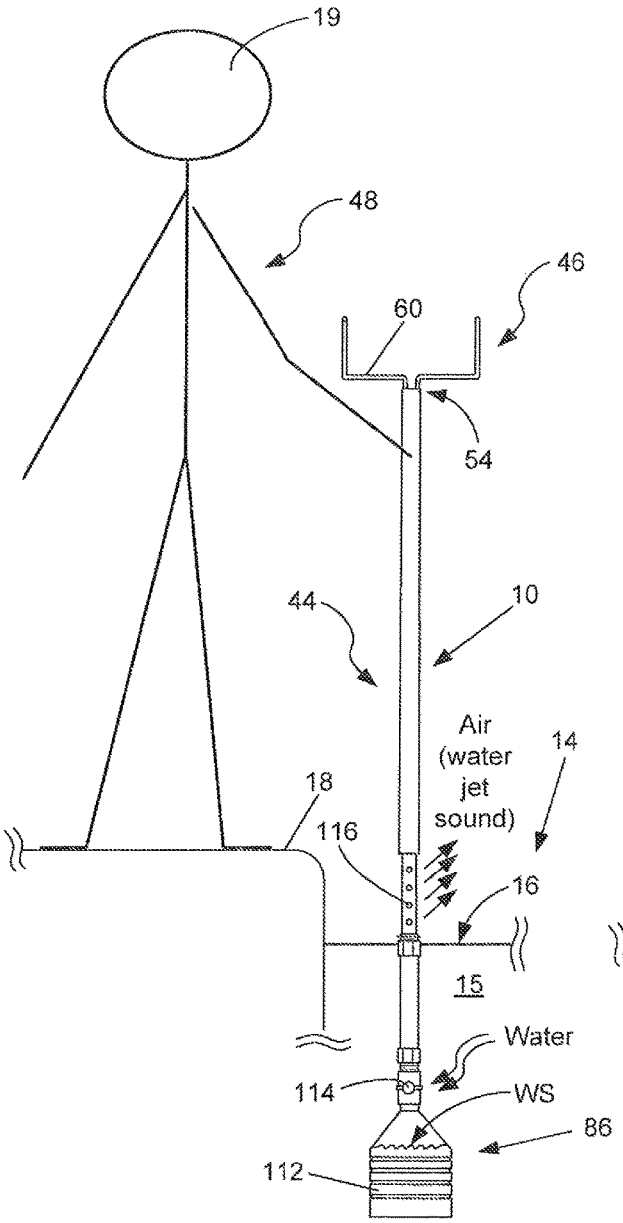
FIG. 14 is a front view of the apparatus of FIG. 13 shown with the venting apertures in their open condition to collect water into the sample bottle.
Figure 15:
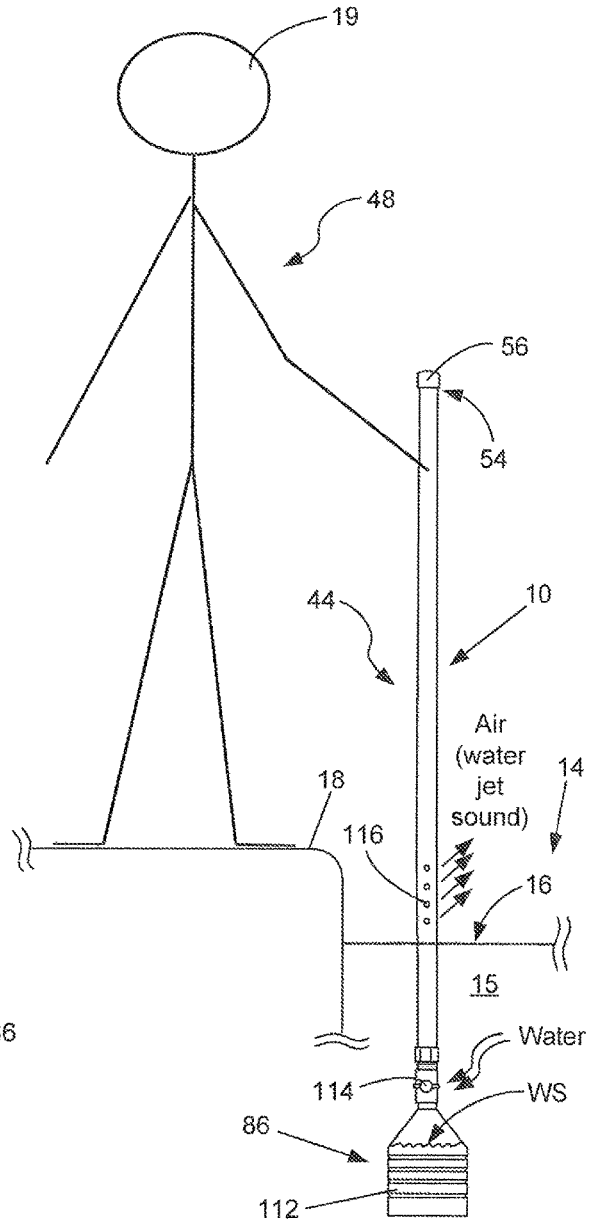
FIG. 15 is a front view of an alternative embodiment of the apparatus of the present invention using one a single tube to capture water in a removable water sample bottle.

An apparatus that is configured pursuant to preferred embodiments of the present invention is referred to generally as 10 in FIGS. 4-5, 8-11 and 14-15. As set forth in more detail below, the new apparatus 10 of the present invention is structured and arranged to be utilized with a skimming system 12 of a swimming pool, spa or the like (collectively referred to as swimming pool 14) having a body of water 15 with a water surface 16 that is, typically, defined by a pool deck 18 which defines the perimeter of the body of water 15, as shown in FIGS. 1 and 14-15. As set forth in more detail below, the new apparatus 10 is configured to assist a user, shown as 19 in FIGS. 8-9 and 14-15, with maintaining the cleanliness and water quality of the body of water 15 in the swimming pool 14 having a skimming system 12 which is configured to collect and remove organic material such as leaves, twigs, dead birds, mice, works, slugs and other surface debris from the body of water 14. A standard skimming system 12 comprises a skimmer reservoir 20 embedded in the pool deck 18 that is hydraulically connected to the body of water 15 of the swimming pool 14 by a skimmer opening 21 to receive therein twigs, leaves, branches, flowers, feathers and slim foreign matter, biological matter such as frogs, snakes and rats, and other debris from the body of water 15. The skimmer reservoir 20 is sized and configured to removably enclose a skimmer basket 22, as shown in FIG. 1, that is utilized to capture and remove debris from the body of water 15 of the swimming pool 14. A typical skimmer basket 22, having an upper rim 24 and a mesh or mesh-like wall 26, is cooperatively sized and configured with the skimmer reservoir 20 to allow water from the body of water 15 to flow into the basket 22. The mesh wall 26 of the basket 22, best shown in FIG. 3, is configured to allow water to pass therethrough and flow back into the body of water 15 while retaining the debris inside the skimmer basket 22 when the basket 22 is positioned inside the skimmer reservoir 20, as shown in FIG. 1, and the skimming system 12 is operating to remove debris from the swimming pool 14. The typical basket 22 also has a transversely positioned rod or bar that functions as a basket handle 28, as best shown in FIG. 3, that is utilized by the user 19 to remove the basket 22 from the skimmer reservoir 20 and then place the basket 22 back into the reservoir 20 after he or she empties the debris from the basket 22.

Figure 2:
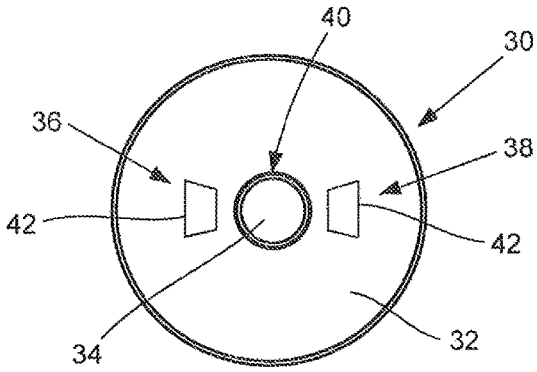
FIG. 2 (PRIOR ART)
FIG. 2 is a top view of the prior art skimmer deck lid of FIG. 1.

To prevent persons from falling into the skimmer reservoir 20 when they are walking on the pool deck 18, most skimming systems 12 have a deck lid 30, which is best shown in FIG. 2, that is sized and configured to fit on and cover the opening into the reservoir 20, as shown in FIG. 1. The deck lid 30 is configured to be removed from the reservoir 20 so the user 19 can access the basket 22 in the reservoir 20 and, as may be necessary, remove and clear out the debris from the basket 22. The lid body 32 of the deck lid 30, which is mostly solid and sufficiently rigid to allow persons to walk across the skimmer reservoir 20, typically comprises a removable cap 34 and a pair of slots, shown as first slot 36 and second slot 38, on either side of the cap 34, as shown in FIG. 2. The cap 34 closes an opening 40 which can be utilized to add chemicals, in solid or liquid form, to the body of water 15 through the skimming system 12. The size and shape of the slots 36/38 in the are defined by slot edges 42. The slots 36/38 are utilized by the user 19 to remove the deck lid 30 from the skimmer reservoir 20, to which the deck lid 30 is threadably or otherwise engaged, so the user 19 can access, remove and replace the basket 22 without using their hands to clean out debris that has been collected inside the basket 22 during operation of the skimming system 12.

As well known to persons who are familiar with pool skimming systems 12, the person who retrieves and empties the skimmer basket 22 from the skimmer reservoir 20 has to bend over the reservoir 20, squat down next to the reservoir 20 or kneel on the pool deck 18 next to the reservoir 20 and use their hands to disengage and remove the deck lid 30 from the reservoir 20 and pull the basket 22 out of the reservoir 20 to empty the debris from the basket 22 and to place the basket 22 back into the reservoir 20 and re-engage the deck lid 30 to cover the reservoir 20. Often the person will stand up or otherwise move around to empty the debris out of the basket 22 onto the nearby ground or into a trash or other container. For many people, the up and down motion to remove the deck lid 18 and basket 22 can be somewhat painful due to problems with sore knees, backs, shoulders and other body joints or parts. For persons who can become dizzy by such motion, the up and down movement can be dangerous. Even persons without sore body joints or parts or dizziness issues, this repetitive movement can be tiresome or annoying and, as a result, can lead to less cleaning of the skimming system 12 than would be considered necessary. As also well known, persons who clean swimming pools 14 professionally can develop sore or injured body joints and body parts due to such repetitive motions. In addition, reaching into the reservoir 20 to grasp the basket handle 28 usually requires the person having to reach into water from the body of water 15, which can be quite cold and slimy due to well aged animal and plant debris.

As set forth in detail below, the apparatus 10 of the present invention is structured and arranged to engage the slots 36/38 in the body 34 of the deck lid 30 and the basket handle 28 of the basket 22 in a manner which allows the user 19 to remove and replace the deck lid 30 and basket 22 while the user 19 remains in a standing position, as shown in FIGS. 8-9 and 14-15. As will be readily appreciated by persons familiar with pool maintenance, this will eliminate the need for the user 19 of the new apparatus 10 to have to bend over, squat down or kneel on the pool deck 18 to remove and replace the deck lid 30 and the basket 22. In addition, the user 19 will not have to place his or her hand in the cold water, which often has slimy contents, in order to grab onto and remove the basket 22, which is located well below the pool deck 18*m* from the reservoir 20. As such, persons with bad knees, backs, shoulders and/or other body joints or parts and persons who are susceptible to dizziness will be able to easily, painlessly and safely engage, remove and replace the deck lid 30 and skimmer basket 22 when performing regular or routine pool maintenance. In addition, professional pool cleaning personnel will be able to perform the task of removing and replacing the deck lid 30 and basket 28 without having to repeatedly bend over, squat down or kneel on the pool deck 18 and keep their arms and hands out of the often cold pool water.

The new apparatus 10 generally comprises an elongated handle 44 and an engaging mechanism 46 that, as set forth in more detail below, are sized and configured to allow the user 19 to engage, remove and replace the deck lid 30 and basket 22 while he or she is in a standing position, shown as 48 in FIGS. 8-9 and 14-15. The elongated handle 44 has a handle body 50 that defines a first or upper end 52 and a second or lower end 54, as best shown in FIGS. 4-5, 8-11 and 14-15. In the embodiment shown in FIGS. 4-7, the handle 44 is a single, elongated tubular member that is made out of PVC or other plastic, fiberglass, aluminum or other material that is relatively lightweight and substantially corrosion resistant so as to be able to be easily handled and resist corrosion in response to exposure to the body of water 15 and the outdoor environment in which the apparatus 10 will typically be utilized. Preferably, the material for handle 44 of the new apparatus 10 is selected so as to not get too hot for the user 19 to comfortably hold when the apparatus 10 is left outside in the sun, which is likely to be typical. In other embodiments, the handle 44 can be made out of two or more elongated members that are connected together and/or are configured in engaging or telescoping arrangement, as shown with regard to the embodiment of FIGS. 10-15. In the first embodiment of the new apparatus 10, the handle 44 has a first end cap 56 located at the first/upper end 52 and a second end cap 58 located at the second/lower end 54 of the handle body 50, as shown in FIGS. 4-9. The end caps 56/58, which may be attached to or integral with the handle body 50, are utilized to close the interior of the tubular handle body 50 in order to prevent water, dirt and other materials from getting inside the handle 44. As best shown in FIGS. 4-7, 10-11 and 14-15, the engaging mechanism 46 is located at the second/lower end 54 of handle 44.

For purposes of describing the present invention, the handle 44 may be any type of elongated member that is, preferably, sized and configured to be easily and comfortably held in the hand of the user 19 and to allow the user 19 to engage the deck lid 30 and basket 22 while in a standing position 48. In addition, for purposes of describing the use and relative location of the various components of the present invention, the terms "upper", "upward", "upwardly", "upper" and "top" and the like and the terms "lower", "downward", "downwardly" and "bottom" and the like refer to the direction, respectively, of the first/upper end 52 and second/lower end 54 of the handle 44 when it is held in its normal upright position when in use to engage the deck lid 30 and the basket 22 with the engaging mechanism 46, which is at the second/lower end 54 of the handle 44, as shown with the apparatus 10 in use in FIGS. 8-9. Likewise, the terms "front", "forward", "forwardly" and the like and the terms "back", "rearward", "rearwardly" and the like are utilized to refer to the direction components of the engaging mechanism 46 are outwardly directed (relative to the elongated handle axis HA through the center of the handle 44, as shown in FIGS. 4-7).

Figure 6:
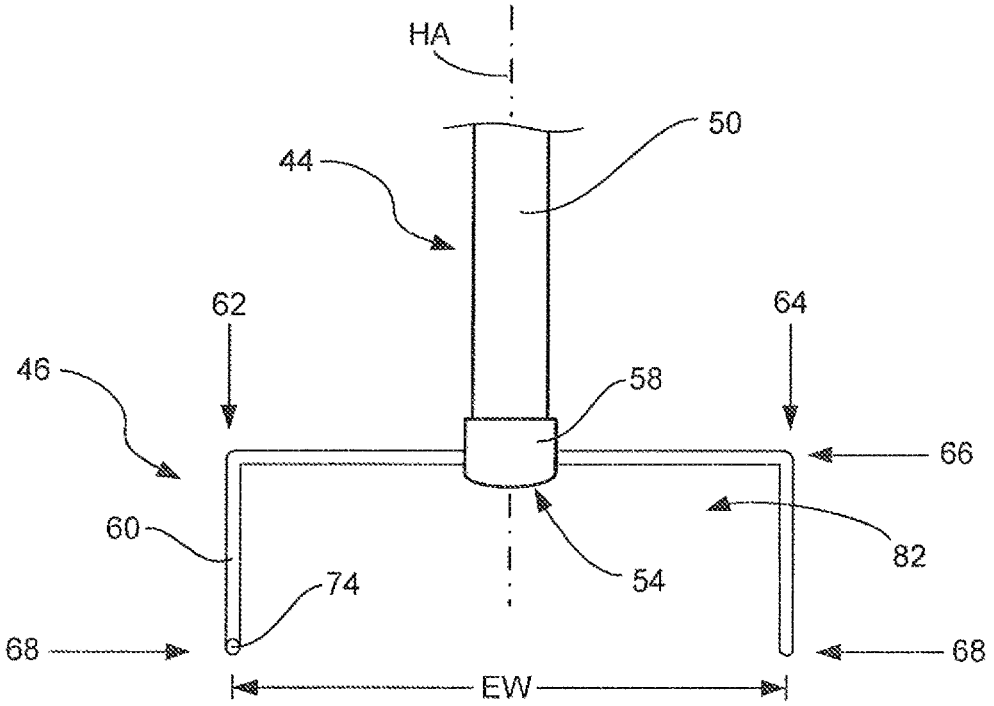
FIG. 6 is an isolated front view of the apparatus of FIG. 4 that better illustrates the engaging mechanism thereof.
Figure 7:
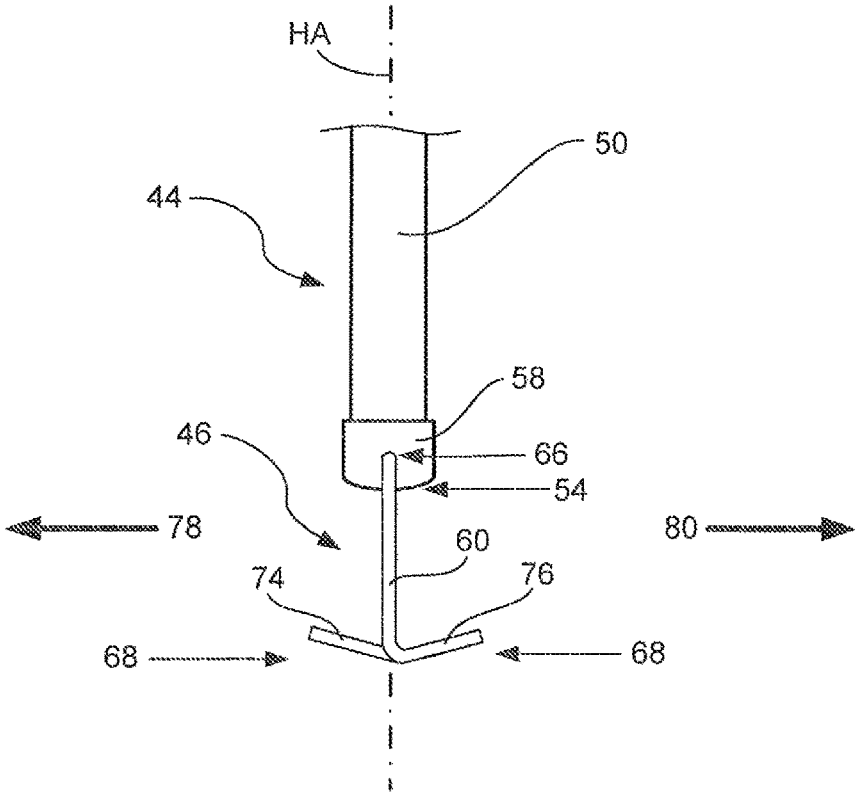
FIG. 7 is an isolated side view of the apparatus of FIG. 6 showing the forward and rearward facing engaging sections of the engaging mechanism.
Figure 8:
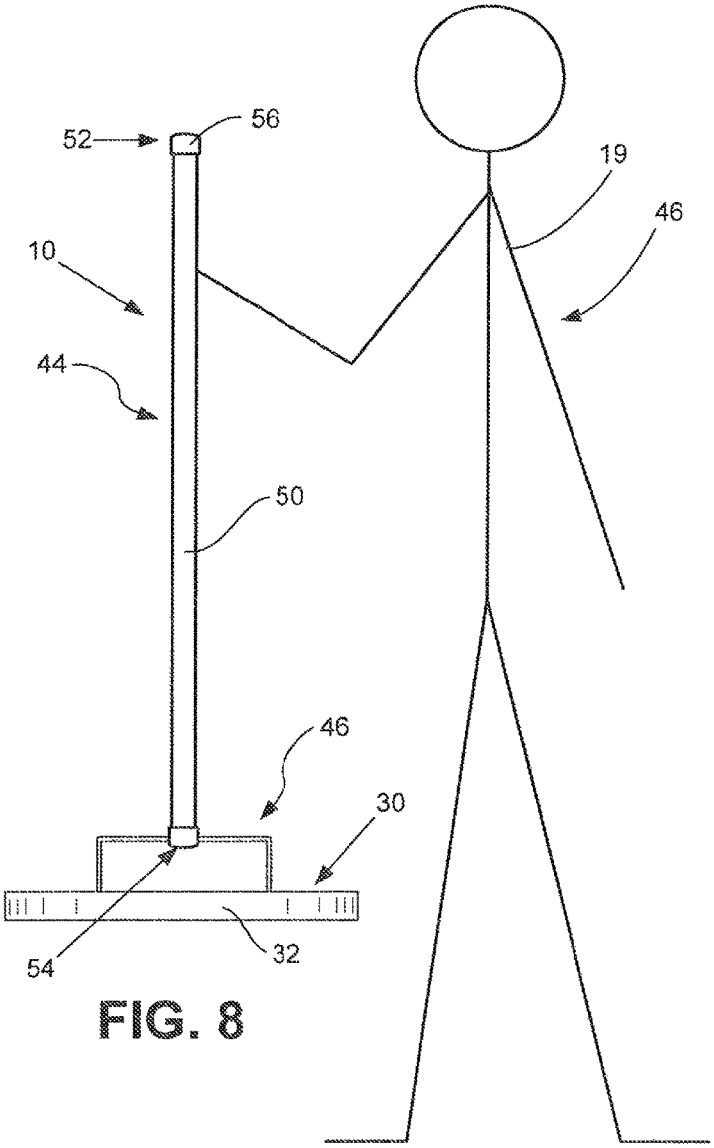
FIG. 8 is a front view of the apparatus of FIG. 4 shown in use by a user engaging and lifting the skimmer deck lid from the skimming system of FIG. 1.
Figure 9:
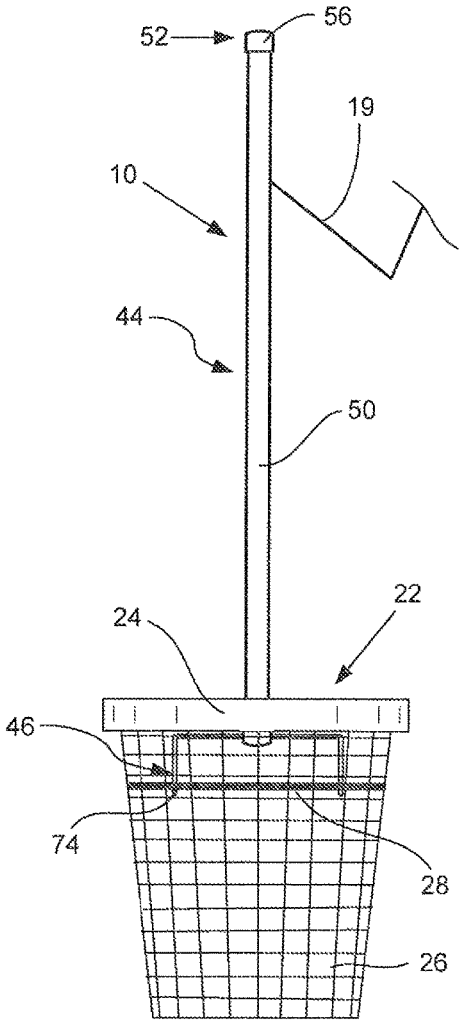
FIG. 9 is a front view of the apparatus of FIG. 4 shown in use by a user engaging and lifting the skimmer basket.

The engaging mechanism 46, which is fixedly attached to or integrally formed with the second/lower end 54 of the handle 44, is structured and arranged to allow the user 19 to easily and securely engage, raise and lower both the deck lid 30 and the apparatus 22 from and to the skimmer reservoir 20 from the standing position 48, as shown in FIGS. 8-9. In one of the preferred embodiments of the apparatus 10 of the present invention, the engaging mechanism 46 comprises a stainless steel or other corrosion resistant wire-like engaging member 60 formed into an inverted U-shaped configuration, as shown in FIGS. 4-6 and 8-15. The resulting U-shaped engaging member 60 defines a first side 62, second side 64, first or upper end 66, second or lower end 68, front side 70 and back side 72 of the engaging mechanism 46. The inverted U-shaped configuration of the engaging member 60 defines an engaging width EW between the first side 62 and second side 64 of the engaging mechanism 46, as shown in FIG. 6. To engage the slots 36/36 of deck lid 30 in a manner which will allow the user 19 to rotatably remove and lift the deck lid 30 off of the skimmer reservoir 20, each side 62/64 of the second/lower end 68 of engaging mechanism 46 has an outwardly disposed (relative to handle axis HA) engaging projection, shown as first engaging projection 74 and second engaging projection 76, that extend outward in opposite directions from each other, as best shown in FIG. 7. In the embodiment shown in the figures, the first engaging projection 74 projects perpendicularly outward in a first or forwardly direction 78 and second engaging projection 76 projects perpendicularly outward in a second or rearwardly direction 80 from the handle axis HA so as to be disposed parallel to each other.

The engaging projections 74/76 are sized and configured to extend sufficiently outward so as to engage the slots 36/38 in the prior art deck lid 30 by extending into the body 32 of the deck lid 30 beyond the respective slot edges 42 so as to engage the slots 36/38 of deck lid 30. To engage the deck lid 30, the user 19 lowers the engaging mechanism 46 down to the deck lid 30 until the one of the engaging projections 74/76 is in one of the slots 36/38 of the body 32 of deck lid 30, as shown in FIG. 8. In one specific use, the user 19 (while standing) lowers the engaging mechanism 46 to position the first engaging projection 74 into the first slot 36 and the second engaging projection 76 into the second slot 38. With the two engaging projections 74/76 in the slots 36/38, the user 19 rotates the engaging mechanism 46 in the direction the two engaging projections 74/76 project until the two engaging projections 74/76 extend beyond the respective slot edges 42. In a typical use, when the engaging mechanism 46 is fully engaged with the deck lid 30, the vertical portion of the engaging member 60 that forms the engaging mechanism 46 will be abutting the respective slot edges 42 of the slots 36/38. As will be readily appreciated by persons skilled in the art, with the slots 36/38 engaged, continued rotation of the handle 44 of the apparatus 10 will rotate the deck lid 30 to allow the user 19 to remove the deck lid 30 off of the skimmer reservoir 20, as shown in FIG. 8. Using the apparatus 10, the user 19 then places the deck lid 30 out of the way so the user 19 can utilize the apparatus 10 to access the skimmer basket 22.

To engage the basket 22, the user 19 lowers the engaging mechanism 46 down into the skimmer reservoir 20 until the basket handle 28 is positioned in the gap 82 between the first side 62 and second side 64 (with gap 82 shown in FIG. 6) of the engaging mechanism 46 with the engaging projections 74/76 facing toward the basket handle 28 and then he or she rotates the engaging mechanism 46 toward the basket handle 28 until both of the engaging projections 74/76 are positioned under the basket handle 28 (typically with the vertical portion of the engaging member 60 that forms the engaging mechanism 46 abutting the basket handle 28). To remove the skimmer basket 22 from the skimmer reservoir 20, the user 19 then lifts the handle 44 upward, which will raise the basket 22 out of the reservoir 20, as shown in FIG. 9. The user 19 can grab the basket 22 at one or more of the rim 24, walls 26 and/or handle 28 thereof to empty any debris therein and, as may be necessary, rinse the debris out of the basket 22. After emptying the debris out of the basket 22, the user 19 positions the basket 22 back into the reservoir 20 by re-engaging the basket handle 28 with the engaging mechanism 46 of the apparatus 10, lowering the basket 22 back into the reservoir 20 and then rotating the engaging mechanism 46 in the opposite direction from that described above (i.e., moving the engaging projections 74/76 away from the basket handle 28). The user 19 replaces the deck lid 30 on the opening of the reservoir 20 by re-engaging the engaging projections 74/76 with the slots 36/38 in the body 32 of the deck lid 30, lowering the deck lid 30 to the reservoir 20 and rotating the deck lid 30, by rotating the handle 44, to engage the deck lid 30 with the reservoir 20 to place the skimming system 12 back in condition for operation, as shown in FIG. 1.

As well known to persons skilled in the art, there are different sizes and configurations of deck lids 30 and skimmer baskets 22. In addition, even for same sizes of deck lids 30 and skimmer baskets 22, some deck lids 30 may have differently sized and positioned slots 36/38 and/or some skimmer baskets 22 may have different sized and positioned basket handles 28. In light of such possible differences, it may be beneficial for some embodiments of the new apparatus 10 to have an adjustable engaging mechanism 46 (i.e., having an adjusting mechanism 84) that allows the user 19 to selectively modify the configuration of the engaging mechanism 46 to correspond to particular deck lids 30 and skimmer baskets 22. As well known, many users 19 who are responsible for cleaning debris from the skimmer basket 22 of the pool skimming system 12 are also the person who is responsible for obtaining a sample of water from the body of water 15 for purposes of testing the sample to see what chemicals need to be added to the body of water 15 to ensure it is safe to swim in, will look clean and will not damage the pool and/or associated pool equipment.

Figure 10:
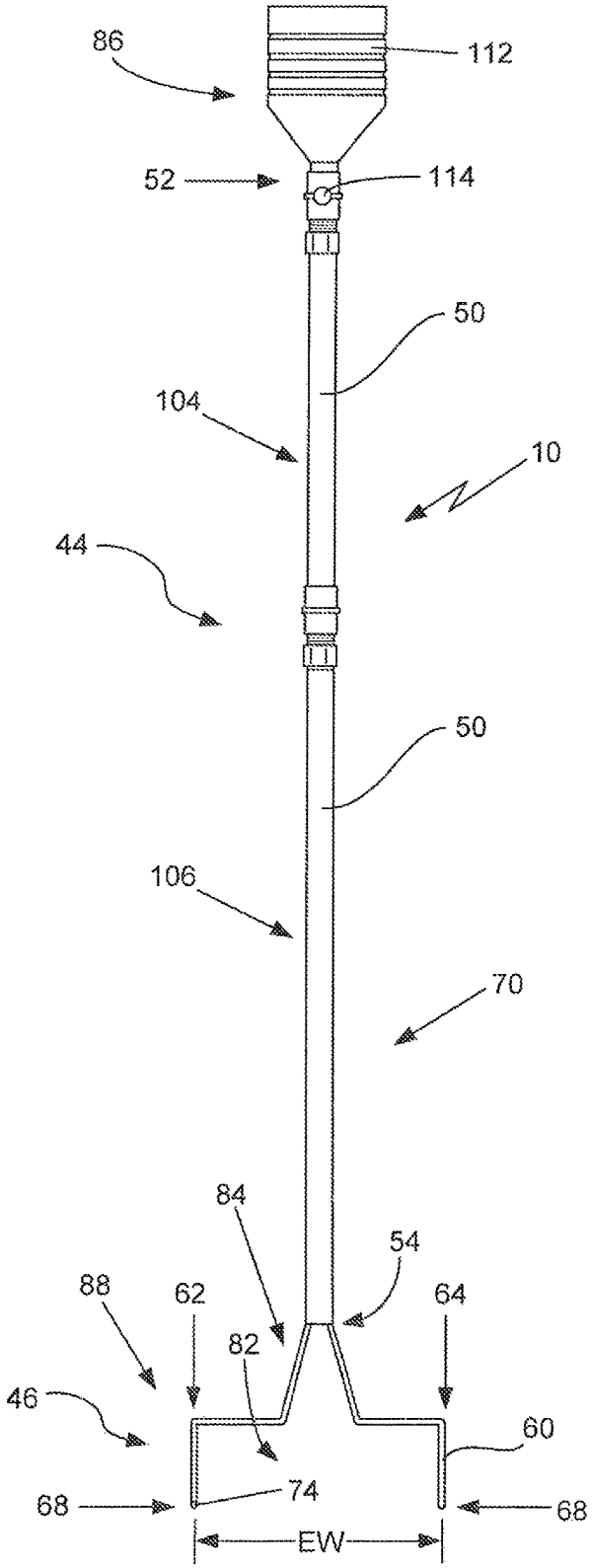
FIG. 10 is a front view of an apparatus for removing the prior art skimmer deck lid and skimmer basket of FIGS. 1-3 from the skimmer reservoir of FIG. 1 that is configured according to a second embodiment of the present invention shown having an adjustable width engaging mechanism for use with different sizes of deck lids having different spacing distances between the slots thereof and/or different sizes of skimmer baskets and shown with a sample bottle for use to capture a sample of the water of the swimming pool, with the engaging mechanism of the apparatus shown in its widest position.
Figure 11:
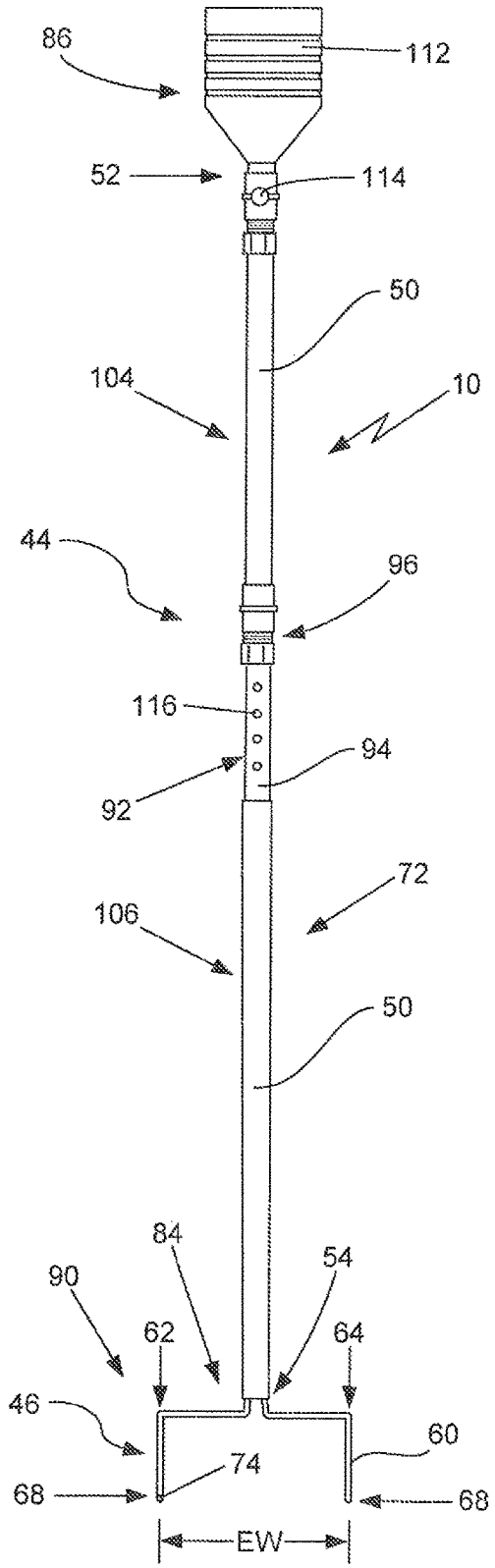
FIG. 11 is a front view of the apparatus of FIG. 10 with the engaging mechanism in its narrowest position and with the venting apertures in an inner tubular member shown exposed in their open condition.
Figure 12:
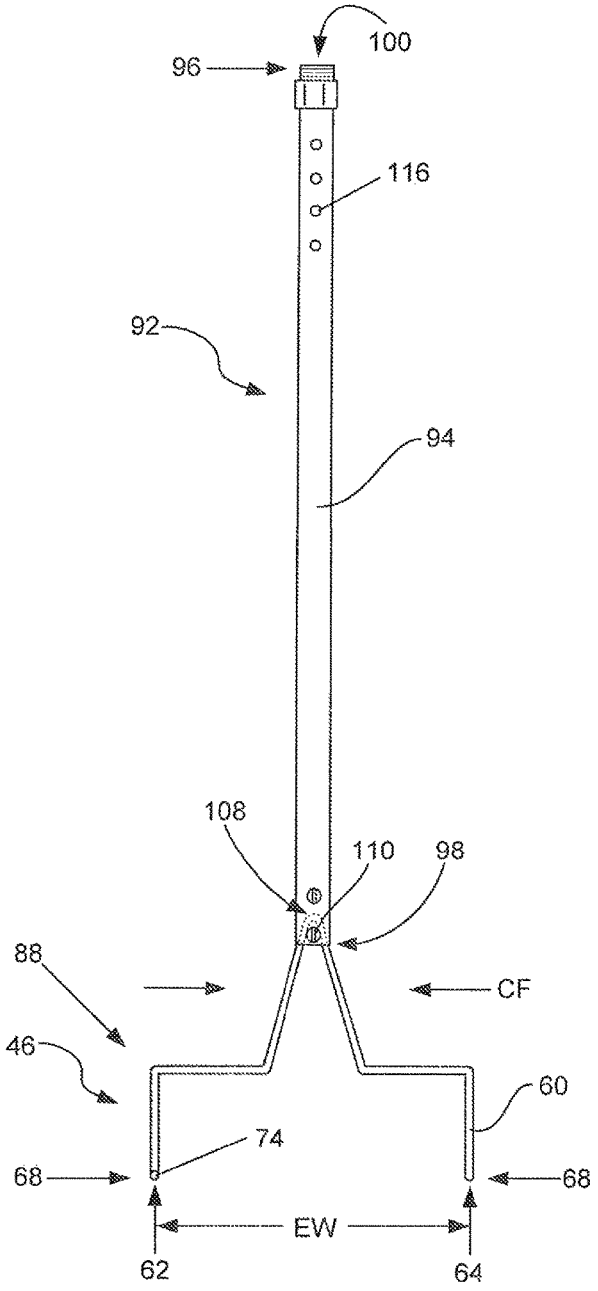
FIG. 12 is a front view of the inner tubular member of FIG. 10 with the engaging mechanism attached thereto and shown in a first engaging width.
Figure 13:
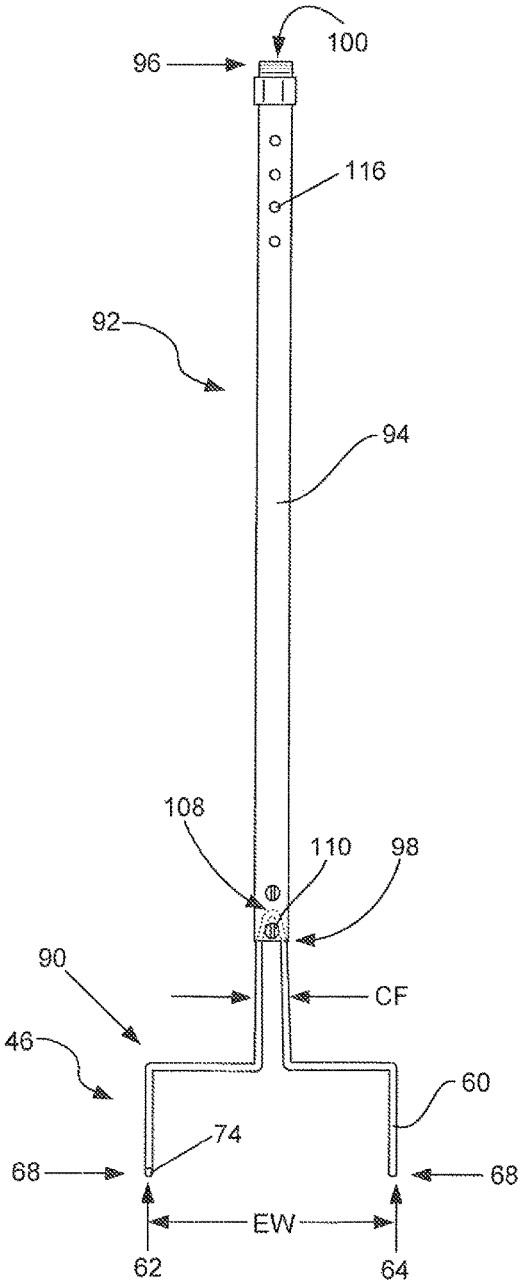
FIG. 13 is a front view of the inner tubular member of FIG. 12 with the engaging mechanism shown in a second engaging width as a result of a collapsing force being applied thereto.

In the embodiment shown in FIGS. 10-15, the apparatus 10 has an adjusting mechanism 84, best shown in FIGS. 10-12, to adjust the width of the engaging mechanism 46 and a sampling mechanism 86, shown in use in FIGS. 14-15 to assist the user 19 with easily and quickly obtaining a water sample (shown as WS in FIG. 15) from the body of water 15. In this embodiment, the adjusting mechanism 84 is telescopically configured and structured and arranged to allow the user 19 to easily and quickly move the engaging mechanism 46 between a relatively wide first engaging width 88, shown in FIG. 10, and a narrower second engaging width 90, shown in FIG. 11. As best shown in FIGS. 11-13, the adjusting mechanism 84 comprises an inner handle member 92 (which is incorporated into the handle 44) having an elongated, tubular member body 94 defining a first or upper end 96, a second or lower end 98 and (in a preferred embodiment) an interior chamber 100 therein and a flexible, inverted generally V-shaped center section 102 associated with the engaging mechanism 46, as best shown in FIGS. 10-12. In this embodiment, which also has the sampling mechanism 86, the entire handle body 50 of the handle 44, which includes member body 94, is tubular and comprises an upper fixed section 104 which is grasped by the user 19 and lower moveable section 106 that interacts with the V-shaped center section 102 of the engaging member 60 of the engaging mechanism 46 to move the engaging mechanism 46 between the first engaging width 88 and second engaging width 90, as best shown in FIGS. 10-11. In other embodiments of the new apparatus 10, such as those not having sampling mechanism 86, just the lower moveable section 106 may need to be tubular (although having the entire handle 44 being tubular also lowers the weight of the apparatus 10).

As shown in FIGS. 10-12, the first/upper end 96 of the inner handle member 92 is attached to or integral with the fixed section 104 of the handle 44 and the moveable section 106 of the handle 44 is slidably engaged with the inner handle member 92 to move upward and downward relative to the inner handle member 92 and, by the fixed connection, to the fixed section 104 of the handle 44. As best shown in FIG. 12, the V-shaped center section 102 of the engaging mechanism 46 has an upper end or apex 108 that is fixedly attached to or integral with the second/lower end 98 of the inner handle member 92 so as to not move relative to inner handle member 92. In the embodiment shown in the figures, the upper end 108 of the V-shaped center section 102 is received inside the interior chamber 100 of the inner handle member 92 and secured in place with one or more connecting devices 110, such as a screw, bolt, pin or the like. The V-shaped center section 102 of engaging mechanism 46 is made out of material, which may be the same for the entire engaging member 60, that is sufficiently flexible such that when a collapsing force, which is shown as CF in FIGS. 12-13, is placed against the sides of the V-shaped center section 102, as shown in FIG. 13, the engaging width EW of engaging mechanism 46 will move to or at least slide toward its second engaging width 88, as shown in FIGS. 11 and 13. When the user 19 removes the collapsing force CF from the V-shaped center section 102, by moving the moveable section 106 upward, the engaging width EW of the engaging mechanism 46 will move to or toward its first engaging width 88, as shown in FIGS. 10 and 12, which is the default engaging width EW for engaging mechanism 46.

In the embodiment shown in FIGS. 10-15, the collapsing force CF is provided by movement of the moveable section 106 of the handle 44 by the user 19, as may be needed to for the engaging projections 74/76 to engage the slots 36/38 of the deck lid 30 or the basket handle 28 of the skimmer basket 22. As shown in FIGS. 10-13, when the engaging mechanism 46 is in its first engaging width 88 and the moveable section 106 is moved downward, relative to the inner handle member 92 (as shown in FIG. 11), the lower end of the moveable section 106 will engage the V-shaped center section 102 and apply the collapsing force CF thereto to move the engaging mechanism 46 toward its second engaging width 90, as best shown in FIGS. 11 and 13. When the user 19 moves the moveable section 104 back upward, he or she will release the collapsing force CF and allow the engaging mechanism 46 to move back to or toward its first engaging width 88. In this manner, the user 19 simply has to move the moveable section 106 of the handle 44 in an upward and downward direction, typically with one hand while the other hand is holding the fixed section 104, to adjust the engaging width EW of engaging mechanism 46.

In an alternative configuration, the adjusting mechanism 84 can comprise the engaging member 60 itself being telescopically or otherwise adjustably configured to move the engaging mechanism 46 between the first engaging width 88 and second engaging width 90 (i.e., extending or retracting the position of the engaging projections 74/76) to increase or decrease the engaging width EW, to correspond with the position of the slots 36/38 in the deck lid 30 and/or the size of the basket handle 28 of the skimmer basket 22. In one possible configuration, the engaging width EW can be selectively modifiable by allowing both sides 62/64 of the engaging member 60 of the engaging mechanism 46 to be able to move inward and outward, thereby moving the engaging projections 74/76 inward and outward, relative to the handle axis HA. In another possible adjusting configuration, the engaging width EW can be selectively modifiable by allowing only one of the sides 62/64 of the engaging mechanism 46 to move one of the engaging projections 74/76 inward and outward. As will be readily appreciated by persons skilled in the art, a variety of different configurations can be utilized with the new apparatus 10 to allow the user 19 to adjust the engaging width EW of the engaging mechanism 46 to correspond to the slots 36/38 of the deck lid 30 and the basket handle 28 of the skimmer basket 22.

As set forth above, the embodiments of the new apparatus 10 shown in FIGS. 10-15 includes a sampling mechanism 86 that can be utilized by the user 19 to obtain a water sample WS from the body of water 15 at an appropriate depth below the water surface 16, as shown in FIGS. 14-15, without having to kneel or lay down on the pool deck 18 and without having to insert his or her arm into the body of water 15. As shown in these figures, using the apparatus 10 of the present invention, the user 19 can obtain the water sample WS from the desired depth while he or she is in the standing position 48. In this embodiment, the sampling mechanism 86 comprises a sample bottle 112 that is removably attached to the first/upper end 52 of the handle body 50 (which is on the bottom when the apparatus 10 is utilized to obtain a water sample WS), one or more inlet apertures 114 at or near the sample bottle 112 and one or more venting apertures 116 through the member body 94, as shown in FIGS. 10-15. In one embodiment, the sample bottle 112 is threadably attached to the first/upper end 52 of the handle 44, which is the upper end of the fixed section 104. To use the sampling mechanism 86, the user 19 will flip the apparatus 10 upside down (i.e., opposite the positioning that is normally utilized to remove the deck lid 30 and skimmer basket 22) with the moveable section 106 of the handle 44 moved to uncover the venting apertures 116 and position the water bottle 112 into the body of water 15, as shown in FIGS. 14-15. The new apparatus 10 also has a correct depth indicating mechanism that is configured to help the user 19 collect a water sample from the desired depth in the body of water 15, which is typically twelve to eighteen inches below the water surface 16. The user 19 lowers the water bottle 112 of the apparatus 10 into the body of water 15 until the venting apertures 116 are positioned just above the surface of the water 16. The user 19 will hear vented air jetting out of the venting apertures 116, creating a water jet sound, indicating that the water collection has started when the water bottle 112 is at the correct depth in the body of water 15. This water jet sound will stop when the water bottle 112 is full, letting the user 19 know that he or she can lift the apparatus 10 up to pull the water bottle 112 out of the body of water 15 and use the collected water sample WS for testing purposes. As shown in FIGS. 14-15, air inside the interior chamber 100 of the inner handle member 92 will vent out through the venting apertures 116 and water from the body of water 15 will flow into the water bottle 112 through the water inlet apertures 114 to collect inside the water bottle 112 as the water sample WS. In a preferred configuration of the sampling mechanism 86, the user 19 disconnects (i.e., by unthreading) the water bottle 112 from the handle 44 and uses the water sample WS therein to test to see what chemicals and what quantity of chemicals may need to be added to the body of water 15 so the body of water 15 can be safe for swimming and not harm the swimming pool 14 and its associated equipment. In one embodiment, sampling mechanism 86 has a plurality of inlet apertures 114 and venting apertures 116 and the water bottle 112 is plastic. As will be readily appreciated by persons who are skilled in the relevant art, a variety of different configurations can be utilized for the sampling mechanism 86. For instance, water bottle 112 can be fixedly attached to or integral with the handle 44 and can have a separate discharge opening that is opened to allow the user 19 to pour the water sample WS out for testing.

As will also be readily appreciated by persons skilled in the art, the new apparatus 10 can be utilized to remove other equipment, whether pool and/or swimming related or not, other than the skimmer basket 22 and deck lid 30 shown in the figures and described above. For instance, the apparatus 10 of the present invention can be utilized to remove items that are configured similar to the deck lid 30 and skimmer basket 22. Specifically, the new apparatus 10 can be utilized to engage and lift other items that have slots 36/38 and/or to engage and remove items that are similar to the skimmer basket 22 having a component similar to the basket handle 28 which can be engaged by the engaging projections 74/76. In addition, the new apparatus 10 can be utilized to obtain liquid samples other than water samples WS from a body of water 15 in a swimming pool 14. For instance, the apparatus 10 can be utilized to obtain a sample of a liquid from a river, lake, pond, water treatment tank or other body of water or from non-water liquid sources in which it would be desirable, if not necessary, to obtain a sample below the surface of the liquid. As such, the term "water" which is utilized herein is not limited to water but is intended to include any liquid which from which a sample of the liquid can be beneficially obtained in a standing position.

While there are shown and described herein specific forms of the invention, it will be readily apparent to those skilled in the art that the invention is not so limited, but is susceptible to various modifications and rearrangements in design and materials without departing from the spirit and scope of the invention. In particular, it should be noted that the present invention is subject to modification with regard to any dimensional relationships set forth herein and modifications in assembly, materials, size, shape and use. For instance, there may be numerous components of the embodiments described herein that can be readily replaced with equivalent functioning components to accomplish the objectives and obtain the desired aspects of the present invention. The various embodiments set forth herein are intended to explain the best mode of making and using the present invention as currently known to and appreciated by the present inventor(s) and to enable other persons who are skilled in the relevant art to make and utilize the present invention. Although, the described embodiments may comprise different features, not all of these features are required in all embodiments of the present invention. More specifically, as will be readily appreciated by persons who are skilled in the art, certain embodiments of the present invention only utilize some of the features and/or combinations of features disclosed herein.

What is claimed is:

1. An apparatus for use with a skimming system having a skimmer reservoir covered by a deck lid and a skimmer basket removably disposed inside the skimmer reservoir, said apparatus comprising:

a handle having an elongated handle body defining a first end and a second end of said handle, said handle having an elongated handle axis through said handle body from said first end to said second end thereof; and an engaging mechanism at said second end of said handle, said engaging mechanism structured and arranged to engage at least one of a first slot and a second slot in the deck lid to remove the deck lid from the skimmer reservoir and to engage the skimmer basket to remove the skimmer basket from inside the skimmer reservoir, said engaging mechanism comprising an engaging member disposed in an inverted U-shaped configuration so as to define a first side, a second side, an upper end, a lower end, a front side and a back side of said engaging mechanism, said engaging mechanism further comprising a first engaging projection extending outwardly in a forwardly direction from said first side of said engaging mechanism and a second engaging projection extending outwardly in an opposite facing rearwardly direction from said second side of said engaging mechanism, said first engaging projection sized and configured to be received in the first slot of the deck lid, said second engaging projection sized and configured to be received in the second slot of the deck lid when said first engaging projection is in the first slot so as to separate the deck lid from the skimmer reservoir, each of said first engaging projection and said second engaging projection being further sized and configured to engage a basket handle of the skimmer basket, wherein said handle and said engaging mechanism are cooperatively structured and arranged to allow a user to separate the deck lid from the skimmer reservoir and to remove the skimmer basket from inside the skimmer reservoir while the user is in a standing position.

2. The apparatus of claim 1, wherein each of said first engaging projection and said second engaging projection are sized and configured to be received under the basket handle of the skimmer basket after the basket handle is received in a gap between said first side and said second side of said engaging mechanism and said engaging mechanism is rotated toward the basket handle.

3. The apparatus of claim 1, wherein said engaging member is configured with said first engaging projection is approximately 75 degrees to 90 degrees relative to said first side of said engaging mechanism and said second engaging projection is approximately 75 degrees to 90 degrees relative to said second side of said engaging mechanism to engage said skimmer basket.

4. The apparatus of claim 1, wherein each of said first engaging projection and said second engaging projection are sized and configured to extend, respectively, beyond a slot edge of said first slot and said second slot of the deck lid to engage the deck lid.

5. The apparatus of claim 1 further comprising an adjusting means associated with at least one of said engaging mechanism and said handle for adjusting an engaging width between said first side and said second side of said engaging mechanism so as to allow the user to adjust the position of the first engaging projection and second engaging projection to correspond to said first slot and said second slot of said deck lid and to said basket handle of said skimmer basket.

6. The apparatus of claim 5, wherein said adjusting means comprises a flexible V-shaped center section associated with said engaging member between said first side and second side of said engaging mechanism and said handle has an elongated inner handle member that is slidably associated with a moveable section of said handle to move said engaging mechanism between a wide first engaging width and a narrow second engaging width.

7. The apparatus of claim 6, wherein said center section is at a lower end of said inner handle member to be flexibly engaged by said moveable section of said handle so as to move said engaging mechanism between said first engaging width and said second engaging width.

8. The apparatus of claim 7, wherein said center section is received inside an interior chamber of said inner handle member and secured to said inner handle member by one or more connecting devices.

9. The apparatus of claim 6, wherein an upper end of said inner handle member is attached to a fixed section of said handle.

10. The apparatus of claim 1 further comprising a sampling means for obtaining a water sample from a body of water, said sampling means comprises a water bottle at said first end of said handle and an inlet aperture associated with said water bottle so as to receive the water sample therein.

11. The apparatus of claim 10, wherein said sampling means further comprises one or more venting apertures associated with said handle so as to create a water jet sound that starts when at the correct depth and stops when said water bottle is full.

12. The apparatus of claim 11, wherein said venting apertures are located on an elongated inner handle member that is slidably associated with a moveable section of said handle, said inner handle member and said moveable section being cooperatively structured and arranged to allow said moveable section to move relative to said inner handle member so as to expose said venting apertures to obtain the water sample from the body of water into said water bottle through said inlet aperture.

13. An apparatus for use with a skimming system having a skimmer reservoir covered by a deck lid and a skimmer basket removably disposed inside the skimmer reservoir, said apparatus comprising:

a handle having an elongated handle body defining a first end and a second end of said handle, said handle having an elongated handle axis through said handle body from said first end to said second end thereof; and an engaging mechanism at said second end of said handle, said engaging mechanism structured and arranged to engage each of a first slot and a second slot in the deck lid to remove the deck lid from the skimmer reservoir and to engage a basket handle of the skimmer basket to remove the skimmer basket from inside the skimmer reservoir, said engaging mechanism comprising an engaging member disposed in an inverted U-shaped configuration so as to define a first side, a second side, a gap between said first side and said second side, an upper end, a lower end, a front side and a back side of said engaging mechanism, said engaging mechanism further comprising a first engaging projection extending outwardly relative to said handle axis in a forwardly direction from said lower end of said first side of said engaging mechanism and a second engaging projection extending outwardly relative to said handle axis in an opposite facing rearwardly direction from said lower end of said second side of said engaging mechanism, said first engaging projection sized and configured to be received in the first slot of the deck lid, said second engaging projection sized and configured to be received in the second slot of the deck lid when said first engaging projection is in the first slot so as to separate the deck lid from the skimmer reservoir, each of said first engaging projection and said second engaging projection being further sized and configured to engage the basket handle of the skimmer basket and/or an upper rim or wall of the skimmer basket when the basket handle is at or in said gap, wherein said handle and said engaging mechanism are cooperatively structured and arranged to allow a user to separate the deck lid from the skimmer reservoir and to remove the skimmer basket from inside the skimmer reservoir while the user is in a standing position.

14. The apparatus of claim 13, wherein said engaging member is configured with said first engaging projection being perpendicular to said first side of said engaging mechanism and said second engaging projection is perpendicular to said second side of said engaging mechanism.

15. The apparatus of claim 13, wherein each of said first engaging projection and said second engaging projection are sized and configured to extend, respectively, beyond a slot edge of said first slot and said second slot of the deck lid to engage the deck lid.

16. The apparatus of claim 13 further comprising an adjusting means associated with at least one of said engaging mechanism and said handle for adjusting an engaging width between said first side and said second side of said engaging mechanism so as to allow the user to adjust the position of the first engaging projection and second engaging projection to correspond to said first slot and said second slot of said deck lid and to said basket handle of said skimmer basket.

17. The apparatus of claim 16, wherein said adjusting means comprises a flexible V-shaped center section associated with said engaging member between said first side and second side of said engaging mechanism and said handle has an elongated inner handle member that is slidably associated with a moveable section of said handle to move said engaging mechanism between a wide first engaging width and a narrow second engaging width.

18. The apparatus of claim 13 further comprising a sampling means for obtaining a water sample from a body of water, said sampling means comprises a water bottle at said first end of said handle, an inlet aperture associated with said water bottle so as to receive the water sample therein and one or more venting apertures associated with said handle to vent air from inside said handle so as to create a water jet sound that starts when said water bottle is at the correct depth and stops when said water bottle is full.

19. The apparatus of claim 18, wherein said venting apertures are located on an elongated inner handle member that is slidably associated with a moveable section of said handle, said inner handle member and said moveable section being cooperatively structured and arranged to allow said moveable section to move relative to said inner handle member so as to expose said venting apertures to obtain the water sample from the body of water into said water bottle through said inlet aperture.

20. An apparatus for use with a skimming system having a skimmer reservoir covered by a deck lid and a skimmer basket removably disposed inside the skimmer reservoir, said apparatus comprising:

a handle having an elongated handle body defining a first end and a second end of said handle, said handle having an elongated handle axis through said handle body from said first end to said second end thereof;

an engaging mechanism at said second end of said handle, said engaging mechanism structured and arranged to engage each of a first slot and a second slot in the deck lid to remove the deck lid from the skimmer reservoir and to engage a basket handle of the skimmer basket to remove the skimmer basket from inside the skimmer reservoir, said engaging mechanism comprising an engaging member disposed in an inverted U-shaped configuration so as to define a first side, a second side, an upper end, a lower end, a front side and a back side of said engaging mechanism, said engaging mechanism further comprising a first engaging projection extending outwardly in a forwardly direction from said first side of said engaging mechanism and a second engaging projection extending outwardly in an opposite facing rearwardly direction from said second side of said engaging mechanism, said first engaging projection sized and configured to be received in the first slot of the deck lid, said second engaging projection sized and configured to be received in the second slot of the deck lid when said first engaging projection is in the first slot so as to separate the deck lid from the skimmer reservoir, each of said first engaging projection and said second engaging projection being further sized and configured to engage the basket handle of the skimmer basket, said handle and said engaging mechanism being cooperatively structured and arranged to allow a user to separate the deck lid from the skimmer reservoir and to remove the skimmer basket from inside the skimmer reservoir while the user is in a standing position;

an adjusting means associated with at least one of said engaging mechanism and said handle for adjusting an engaging width between said first side and said second side of said engaging mechanism so as to allow the user to adjust the position of the first engaging projection and second engaging projection to correspond to said first slot and said second slot of said deck lid and to said basket handle of said skimmer basket; and a sampling means for obtaining a water sample from a body of water, said sampling means comprises a water bottle at said first end of said handle, an inlet aperture associated with said water bottle so as to receive the water sample therein and one or more venting apertures associated with said handle to vent air from inside said handle so as to create a jet sound that starts when said water bottle is at a correct depth and stops when said water bottle is full.

* * * * *